US008757514B1

(12) United States Patent
Perello et al.

(10) Patent No.: US 8,757,514 B1
(45) Date of Patent: Jun. 24, 2014

(54) SPRAY SYSTEM WITH REMOTE TARGET INSPECTION AND ACTUATION

(71) Applicants: Rick Perello, Duarte, CA (US); Harold Long, Huntington Beach, CA (US)

(72) Inventors: Rick Perello, Duarte, CA (US); Harold Long, Huntington Beach, CA (US)

( * ) Notice: Subject to any disclaimer, the term of this patent is extended or adjusted under 35 U.S.C. 154(b) by 0 days.

(21) Appl. No.: 13/939,497

(22) Filed: Jul. 11, 2013

(51) Int. Cl.

| | |
|---|---|
| ***B67D 7/08*** | (2010.01) |
| ***A62C 31/24*** | (2006.01) |
| ***B05B 15/06*** | (2006.01) |
| ***B67D 7/84*** | (2010.01) |

(52) U.S. Cl.
USPC ..... 239/280.5; 239/73; 239/280; 239/532; 239/587.1; 222/174

(58) Field of Classification Search
USPC ..... 239/71, 73, 74, 280, 280.5, 281, 532, 239/587.1; 222/174; 248/128
See application file for complete search history.

(56) References Cited

U.S. PATENT DOCUMENTS

| | | | | |
|---|---|---|---|---|
| 3,856,209 | A * | 12/1974 | Hickson | 239/532 |
| 4,789,084 | A * | 12/1988 | Yoshitomi | 222/174 |
| 6,450,423 | B1 * | 9/2002 | Gurule | 239/531 |
| 6,889,920 | B2 * | 5/2005 | Nance et al. | 239/587.1 |
| 7,252,210 | B1 * | 8/2007 | Schultz et al. | 222/174 |
| 7,717,300 | B1 * | 5/2010 | Yarrusso, Jr. | 222/174 |
| 8,444,020 | B1 * | 5/2013 | Kenny | 222/174 |

* cited by examiner

*Primary Examiner* — Ryan Reis
(74) *Attorney, Agent, or Firm* — Patent Law & Venture Group; Gene Scott

(57) ABSTRACT

The apparatus and its method of use is directed to a spraying system which has a strut rotationally joined at an upper end of an elongated pole. A sprayer is removably engaged with the strut. An electrical actuator is also engaged with the strut and is positioned for operating the sprayer. An electrical circuit includes components for controlling the sprayer, for video recording a spray target, for viewing the recording on a monitor. The strut is adapted by an offset to place the operating line of the actuator's trigger coincident with the sprayer's operator. The pole may be adjusted as to length for higher and lower targets.

9 Claims, 4 Drawing Sheets

SPRAY SYSTEM WITH REMOTE TARGET INSPECTION AND ACTUATION

BACKGROUND

This disclosure relates to the field of sprayers and spray systems and their methods of use and particularly to a pole mounted sprayer having novel features of control. Generally, a sprayer is a device used to spray a liquid. In agriculture, a sprayer may be a piece of equipment with spray nozzles which is used to apply herbicides, pesticides, and fertilizers onto agricultural crops. Sprayers range in size from portable units which are hand held or mounted in backpacks with spray guns, to trailered sprayers that are motorized, and also include self-propelled units similar to tractors that have boom mounts which may reach up to 150 feet in length. Of course, sprayers include simple pressurized handheld cans for aerosol spraying of paint, pesticides, foams, smokes and many other materials. Often, it is difficult to reach a position where it is desired to deliver a spray, for instance, it may be difficult to reach a bee, wasp, and hornet nests that is built under high roof eaves. Therefore, a need exists for more easily gaining access to difficult-to-reach locations to deliver sprays with accuracy while maintaining a safe distance. There is also a need for delivering a spray of teargas, nerve gas, or other bioactive chemical agent while maintaining a safe distance when approaching a suspected location of dangerous individuals wherein it may be possible to subdue such individuals without generating a physical conflict. The presently described apparatus and method of use provides a novel solution to these and similar needs.

BRIEF SUMMARY AND OBJECTIVES

The presently described apparatus and method of use is directed to a spraying system which has an offset strut rotationally joined at an upper end of an elongated pole. A securement for a sprayer is fixed to the strut and the sprayer is removably engaged with the securement. An electrical actuator is fixed to the strut and positioned for operating the sprayer. An electrical circuit includes a power supply and, at a lower end of the pole, a switch for operating the actuator linearly in forward and reverse directions. The strut is adapted to place the movement of the actuator in line with the sprayer's operator.

Objectives of the present apparatus and method of use include: spraying materials onto target locations that are too high to reach with usual means; visualizing close details of high target locations from ground level; remotely actuating and deactivating a sprayer that is positioned adjacent to a target which is at a high location; adjusting a sprayer's angular attitude with respect to a support pole for delivering a spray at a selected angle; and also having the ability for exchanging a spent sprayer with a replacement quickly and easily.

BRIEF DESCRIPTION OF THE DRAWINGS

Like reference symbols in the drawing figures indicate like elements.

DETAILED DESCRIPTION

Figure 1:
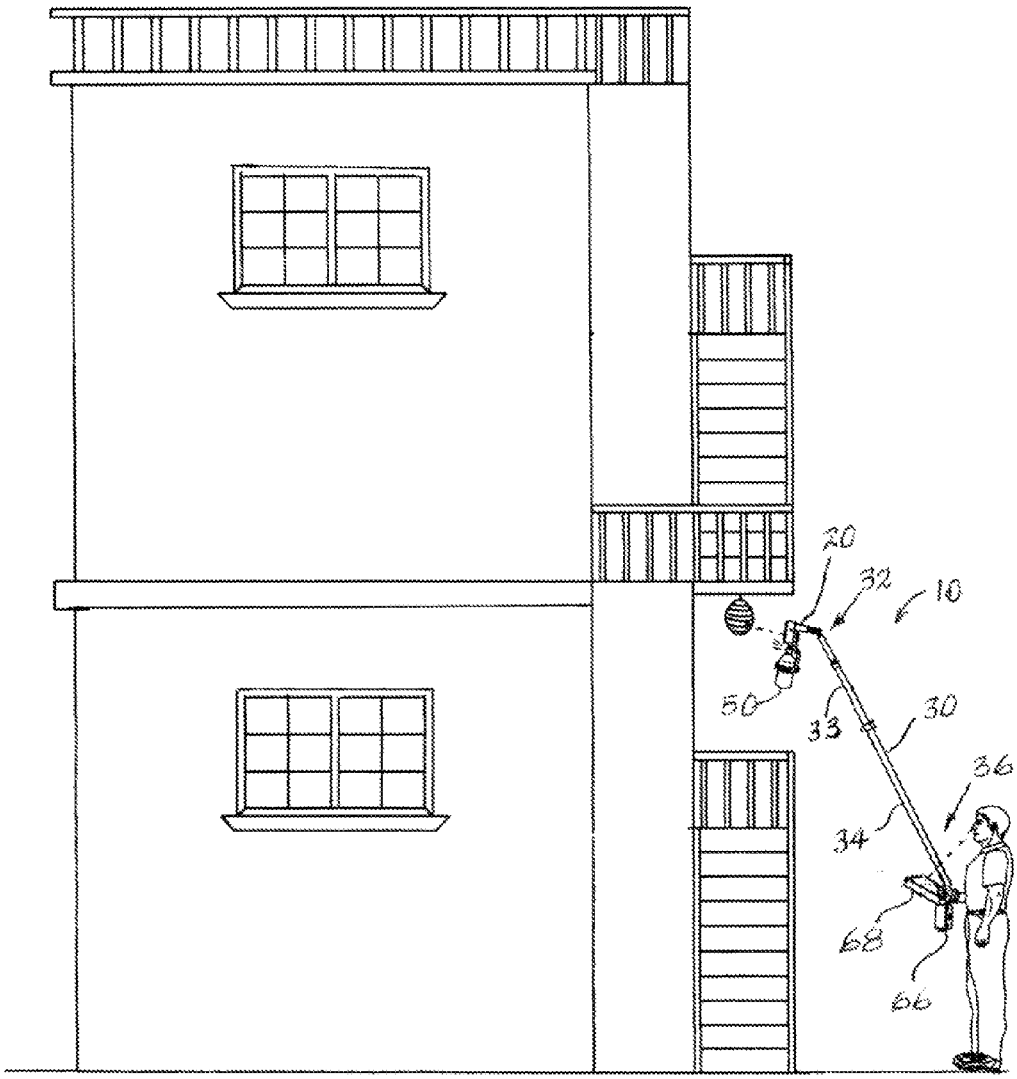
FIG. 1 is an example perspective view of the presently described apparatus showing a pole with components mounted being held by a person in order to position a sprayer in a high position.

As shown in the figures, the presently described apparatus and method of use is a spraying system apparatus 10 which may have an end assembly 20 rotationally joined to an upper end 32 of an elongated pole 30 such as sold by Mr. LongArm, Inc. of Greenwood, Mo. As shown in FIG. 1, pole 30 may have plural mutually engaged co-linear segments 33 and 34 so that pole 30 may be adjusting in length by sliding one of segments 33, 34 within the other.

End assembly 20 may be made up using five structural elements including: an angle adapter 22 such as model 0150 sold by Mr. LongArm, Inc., tube 24, offset strut 26, enclosure 65, and gripping means 40.

Figure 2:
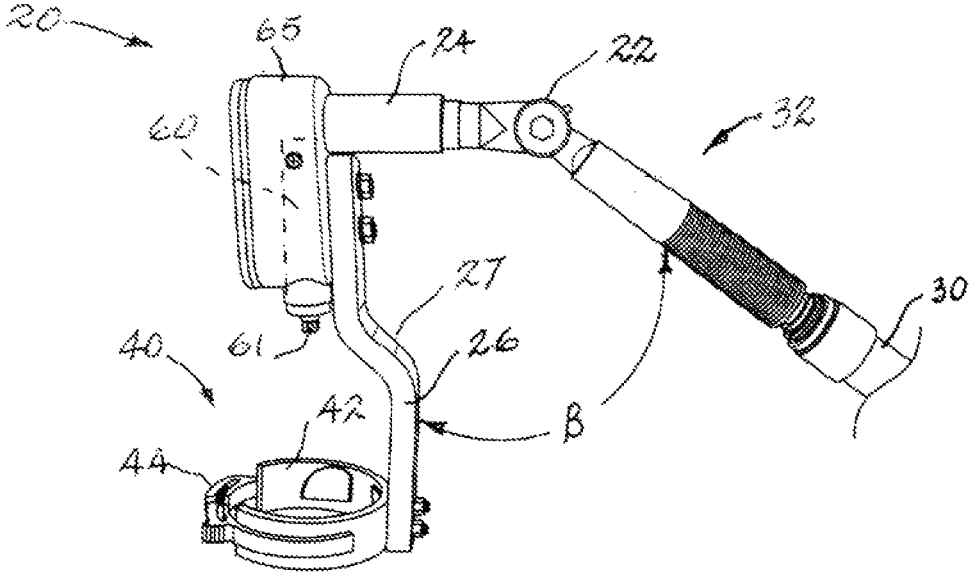
FIG. 2 is an example elevation view of an upper portion thereof.

End assembly 20 may be arranged so that strut 26 may be positioned at an acute angle β relative to pole 30 as shown in FIG. 2. Therefore, as shown in FIG. 1, pole 30 may be held in a non-vertical attitude while placing strut 26 in a more-or-less vertical attitude including any position necessary for directing a spray as will be discussed below.

Figure 3:
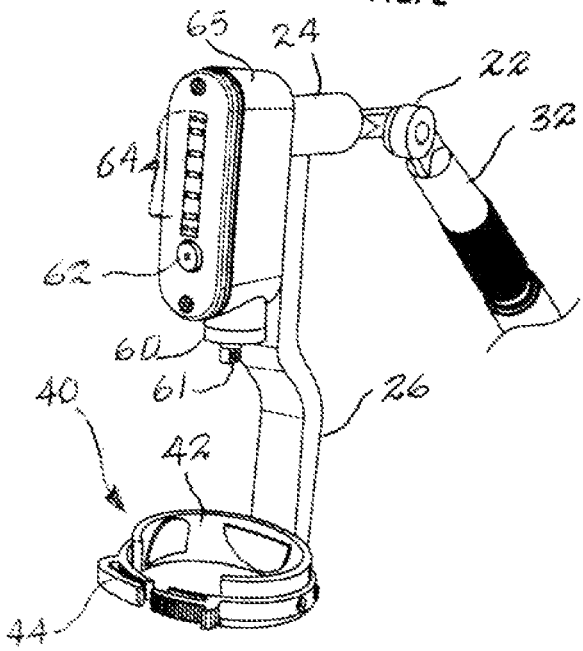
FIG. 3 is an example perspective view thereof.
Figure 4:
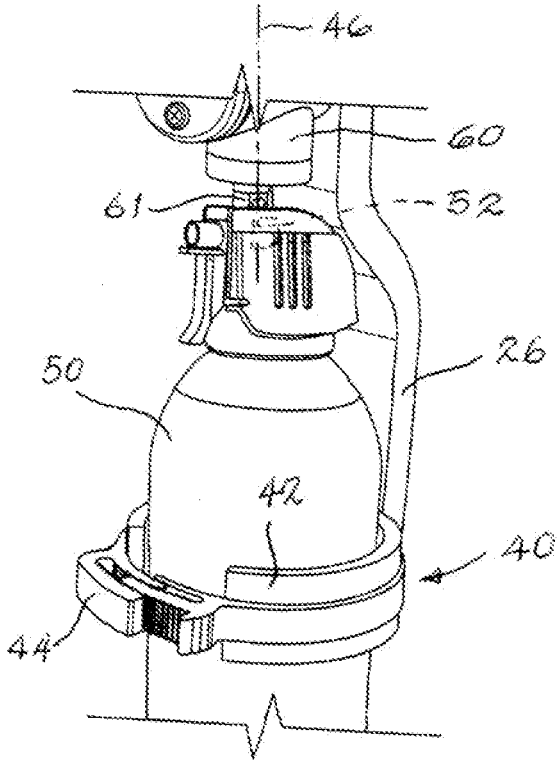
FIG. 4 is an example elevation view of a sprayer help by a mounting thereof.

As shown in FIG. 2, angle adapter 22 is mounted on the end 32 of pole 30 and may be adjusted by its elbow joint to set a desired angle between pole 30 and offset strut 26. As shown in FIGS. 2-4, gripping means 40 may receive a sprayer 50, so that it is fixed to strut 26. Gripping means 40 may include a C-clamp 42 which may be tightened by a common strap tightener 44. Sprayer 50 may be placed into clamp 42 and then secured using strap tightener 44 as best shown in FIG. 4. Strap tightener 44 may be a modified HERBIE CLIP® as supplied by HCL Clamping Solutions of Radstock, Bath, UK. A common sprayer 50 will have a limited spraying capacity and when exhausted, sprayer 50 may be replaced or refilled by loosening strap tightener 44. An actuator 60 may be mounted within an enclosure 65 which may be mounted on a first (upper) portion of strut 26 as shown in FIG. 2, and actuator 60 may be positioned for operating sprayer 50 as will be described. As shown in FIG. 3, a video camera 62 and a light strip 64 may also be mounted within enclosure 65.

Figure 5:
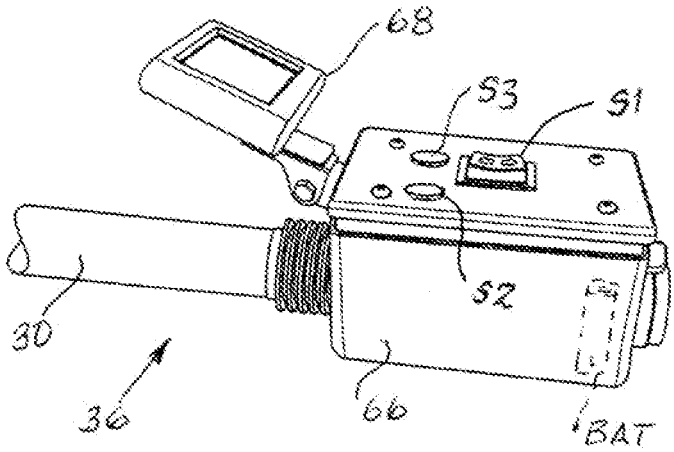
FIG. 5 is an example elevation view of a lower portion thereof.

As shown in FIG. 5, a further enclosure 66 may be mounted at a lower end 36 of pole 30. A video monitor 68 may be mounted on enclosure 66 as shown and first, second and third switches S1, S2, and S3 may be mounted within enclosure 66 providing manual access thereto as shown.

Figure 6:
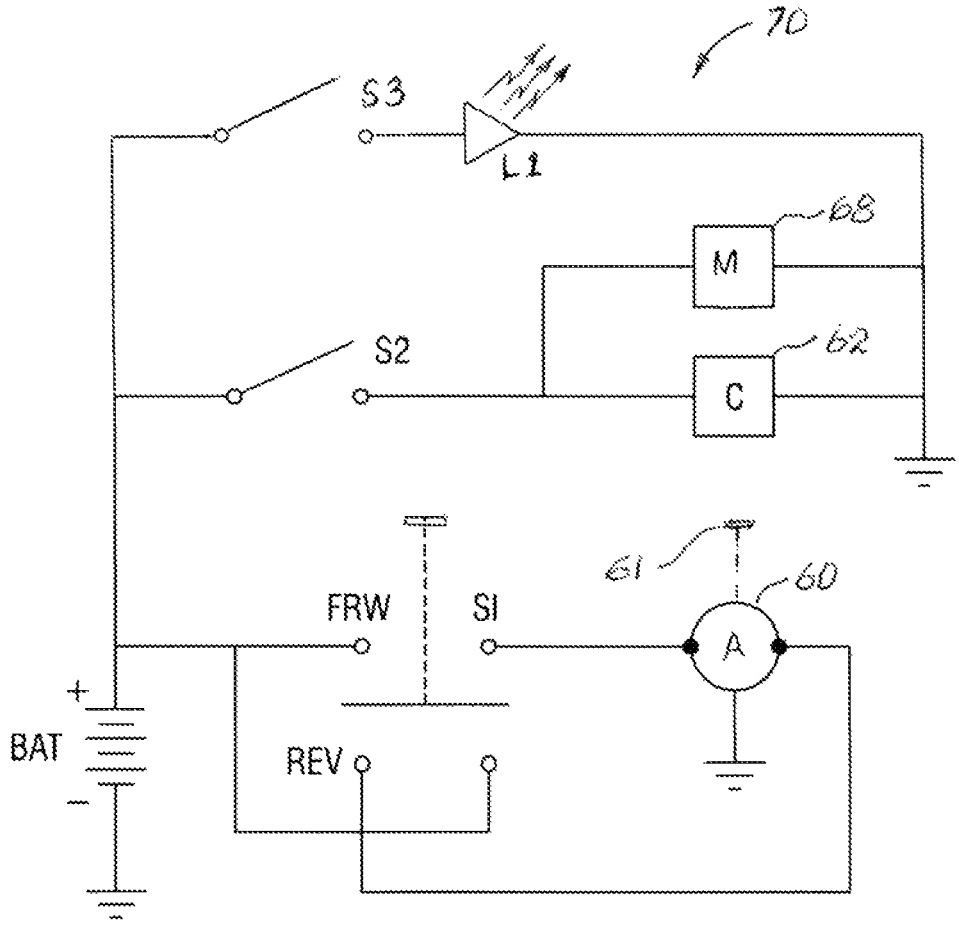
FIG. 6 is an electrical schematic diagram thereof.

As shown in the electrical schematic of FIG. 6, apparatus 10 may include an electrical circuit 70 which may include a DC power supply BAT, the first switch S1, the actuator 60, the second switch S2, the video camera 62 (FIG. 3), the video monitor 68, the third switch S3, and the lamp L1 (element 64 in FIG. 3). These electrical components may be arranged and interconnected as shown in FIG. 6. First switch S1 may be a common single pole, double throw toggle type, as shown, that is able to be moved manually between a forward (FRW) position for driving actuator 60 in a forward direction, and a reverse (REV) position for driving actuator 60 in a reverse direction. Actuator 60 may be a model L12 Miniature Linear Actuator as sold by Firgelli Technologies of Victoria, BC, Canada, and may be obtained in 10, 30, 50, and 100 mm strokes. Other common actuators may alternately be used.

Second switch S2 may be a common single pole, single throw type that is positioned in circuit 70 to supply power to both video camera 62 and video monitor 68. Camera 62 may be model RY-203 Mini Pinhole AV camera as supplied by Shenzhen Ruiye Electronic Co. of Shenzhen Guangdong, China. Other common miniature cameras may alternately be used. Monitor 68 may be a 2.5 inch TVT Color LCD type monitor supplied by Sumas Media of City of Industry, Calif. Other common miniature monitors may alternately be used.

Third switch S3 may also be common single pole, single throw type for supplying power to lamp L1(64) which may be a linear LED lighting array as supplied by Osram Sylvania of Danvers, Mass. Other common lamps may alternately be used. Lamp L1 may be positioned for illuminating the field of view of camera 62 as is shown in FIG. 3.

As shown in FIG. 2, strut 26 may be configured, as for instance by the offset bend shown, to place an operating linear axis 46 of actuator 40 in linear alignment with a sprayer operator 52. Therefore when trigger 61 of actuator 60 is driven into contact with sprayer operator 52 spraying action is initiated, and when trigger 61 is moved out of contact, spraying action ceases. By toggling first switch S1 back and forth, spraying action can be closely controlled. The offset bend of strut 26 places the two portions of strut 26 on opposing sides of the offset bend 27, that is, in adjacent planes and the offset magnitude enables trigger 61 to align with operator 52.

Interconnecting power and signal conductors (wires) which are represented schematically in FIG. 6 for powering the several components described above may be routed externally to pole 30 and assembly 20, or may be routed within pole 30 and assembly 20 as desired and in accordance with common engineering practice for interconnecting components with power and the transmission of signals. Battery BAT may be stored in enclosure 66, as shown, which may be mounted on the lower end 36 of pole 30 and power may be supplied through switch S3 to lamp L1(64) via a power wire (not shown) that may be taped to the outside of pole 30. Likewise, power may be supplied to camera 62 through switch S2 and to actuator 60 via switch S1 in like manner. Power to monitor 68 may be supplied through switch S2 via a short wire from enclosure 66.

Embodiments of the subject apparatus and method have been described herein. Nevertheless, it will be understood that modifications may be made without departing from the spirit and understanding of this disclosure. Accordingly, other embodiments and approaches are within the scope of the following claims.

What is claimed is:

1. A spraying system apparatus comprising:

an end assembly joined to an upper end of an elongated pole, the end assembly including: an angle adapter, a tube, an offset strut, and a gripping means;

the gripping means attached to the offset strut for clamping around a sprayer;

an actuator fixed to the offset strut in a position for actuating the sprayer along an axis of linear motion coincident with a sprayer operator of the sprayer;

an electrical circuit including a power supply engaged electrically through switches with the actuator, a video monitor, and a video camera, the video camera mounted adjacent to the actuator, and the video monitor mounted on a lower end of the pole.

2. The apparatus of claim 1 wherein the video monitor is positioned adjacent to a first switch, the first switch interconnected for operating the actuator.

3. The apparatus of claim 2 wherein the electrical circuit further includes a second switch interconnecting the power supply to the video camera and the video monitor.

4. The apparatus of claim 1 wherein the pole has plural mutually engaged segments positionable for adjusting a length of the pole.

5. The apparatus of claim 1 wherein the first switch is interconnected in the circuit for controlling the actuator in linear motion toward the gripping means.

6. The apparatus of claim 1 wherein the electrical circuit further includes a third switch interconnecting a power supply to a lamp, said lamp positioned adjacent to the camera enabling illumination of a camera field of view.

7. The apparatus of claim 1 wherein the gripping means includes a C-clamp and a means for tightening said C-clamp.

8. The apparatus of claim 7 wherein the offset strut has a medially positioned offset of a magnitude placing a sprayer operator in line with motion of the actuator when a sprayer is secured by the gripping means.

9. A spraying system apparatus comprising:

an end assembly joined to an upper end of an elongated pole, the end assembly including: an angle adapter, an offset strut, and a gripping means wherein the angle adapter is joined with the offset strut for adjusting an angle between the pole and the offset strut;

the gripping means attached to the offset strut for clamping around a sprayer;

an actuator fixed to the offset strut in a position for actuating the sprayer along an axis of linear motion coincident with a sprayer operator of the sprayer;

an electrical circuit including a power supply engaging the actuator, a video monitor, and a video camera.

* * * * *